United States Patent [19]

Royer

[11] 4,108,434

[45] Aug. 22, 1978

[54] MULTI-NET TABLE TENNIS APPARATUS

[75] Inventor: George Ronald Royer, Toledo, Ohio

[73] Assignee: Robert L. Bratton, Swanton, Ohio ; a part interest

[21] Appl. No.: 775,578

[22] Filed: Mar. 8, 1977

[51] Int. Cl.[2] ..... A63B 61/00

[52] U.S. Cl. ..... 273/30

[58] Field of Search ..... 273/1 R, 29 A, 30, 176 E, 273/176 G, 81, 3, 95 H

[56] References Cited

FOREIGN PATENT DOCUMENTS 852,666 11/1939 France ..... 273/1 R 847,746 10/1939 France ..... 273/1 R 849,918 12/1939 France ..... 273/1 R

*Primary Examiner*—Richard C. Pinkham

*Assistant Examiner*—T. Brown

[57] ABSTRACT

A table tennis game for four players comprising a table having an upper playing surface which has intersecting nets which divide the upper playing surface into four sectors shaped substantially as quadrants, each such sector comprising the individual playing areas for each of the four individual players. A circular member lies in the center of the table at the intersection of the four nets for purposes of receiving insufficiently hit table tennis balls, with such circular member being utilized as part of the game play scoring.

2 Claims, 1 Drawing Figure

MULTI-NET TABLE TENNIS APPARATUS

KNOWN PRIOR ART

1. U.S. Pat. No. 3,452,985 — C. J. D'Zmura
2. U.S. Pat. No. 2,497,925 — R. Bergerioux

DESCRIPTION OF PRIOR ART

In the prior art there are a myriad of games played by several players on table or other surfaces. There are, moreover, many games played by persons wherein the purpose is to bat around a projectile between various players in or on playing zone using various devices. One refined version of the latter general type of game is table tennis in which a table tennis ball, variously called a ping pong ball is batted back and forth over a net bisecting the longitudinal meridian of a rectangularly shaped table. The structure and play of this latter game is obviously well known to most persons and further description thereof is not necessary for purposes of discussing the prior art.

A recent variation of the game of table tennis is seen in U.S. Pat. No. 3,452,985, wherein a circular shaped playing surface is used in which intersecting nets divide the playing surface into four quadrants for each of four players to play at individuals. In this latter game the four individual players play as individuals and attempt to knock the ping pong ball, or similar projectile, back and forth at random against one another until a player misses a ball projected into his quadrant or propels a ball off the table or playing zone. Points are accumulated on a negative basis. Specifically, a player who has missed a cumulative total of an arbitrarily designated number of missed hits drops out of the game and the remaining three players continue play accordingly until two are left who play out the remainder of the game. Variations of the game are several, but it is sufficient to say at this juncture that the variations of play do not extend appreciably beyond what has been described.

The proposed game herein is a more refined variation of the four player table tennis or tennis game variously described above and is seen in U.S. Pat. No. 3,452,985, referred to hereinabove. In the subject invention and variation of the game, a circular hollow member having a height about the same as that of the nets is placed in the middle of the board to add additional excitement and challenge to the play of the game, as more fully described in the specifications set forth hereinafter.

OBJECTS

It is an object of the subject invention to provide a novel game which is a variation of table tennis for four individual players:

Moreover, another object is to provide a novel game;

Yet another object is to provide an improved game for multiplayer usage;

Still another object is to provide an improved game for multiple individual players.

Other objects will become evident from a reading of the following description taken in conjunction with the following drawings.

DRAWINGS

FIG. 1 is a perspective view of a player surface incorporating the subject invention.

DESCRIPTION OF GENERAL EMBODIMENT

The subject invention is a novel game being an improved and novel game which is a variation of table tennis, in its most specific embodiment. In this regard, a table tennis or other playing surface with intersecting nets are used creating a playing table or other surface which can be utilized by four individual players playing as individuals among themselves. In the center of the table is a circular or cuplike member designed to receive insufficiently hit balls for purposes of providing an additional and novel scoring variations in the game play, as more particularly described below.

DESCRIPTION OF PREFERRED EMBODIMENT

Figure 1:
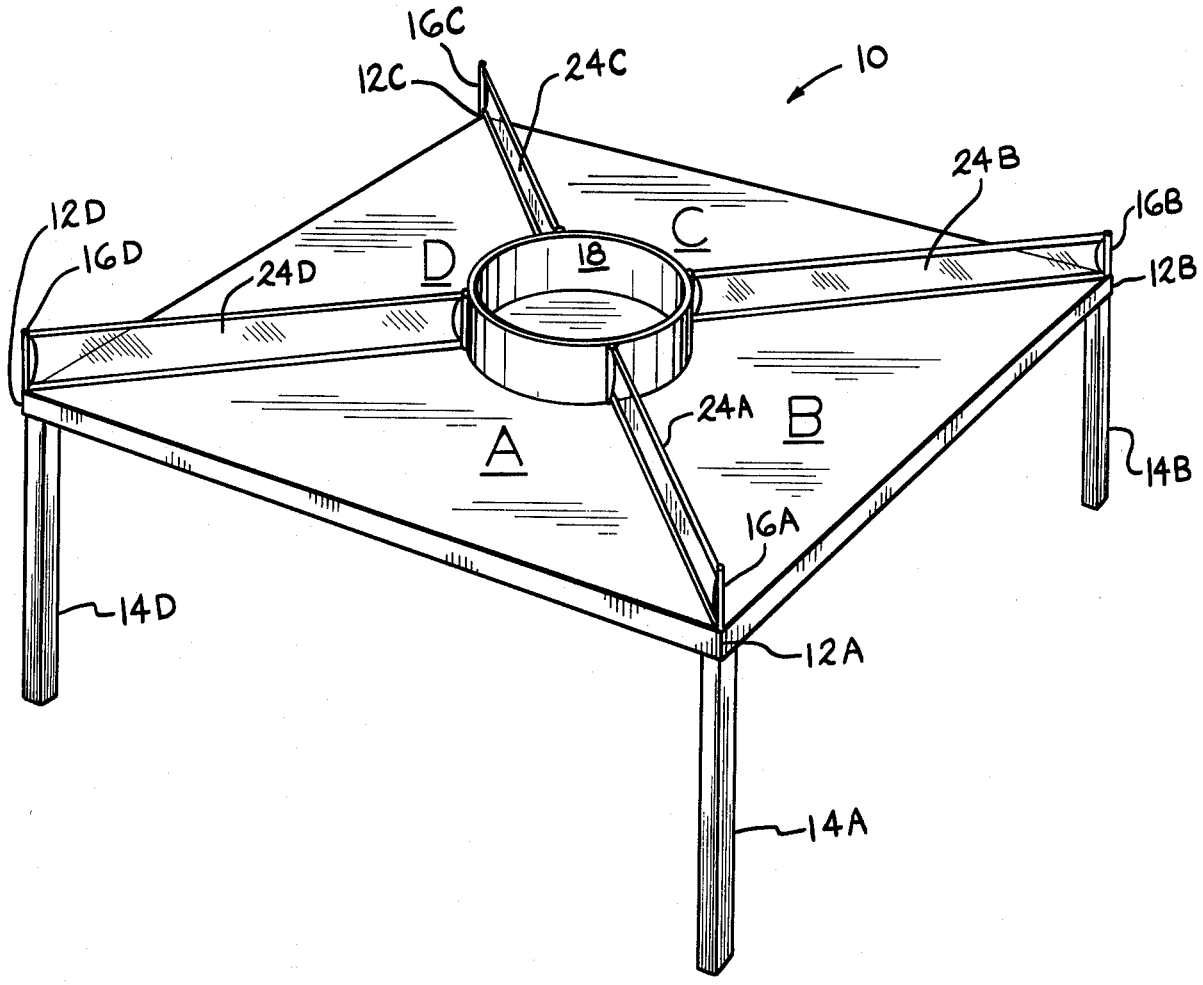

Referring now to the drawing in which a preferred embodiment is shown, a table 10 with a rectangularly shaped upper playing surface 11 is shown. For purposes of constructing a preferable embodiment, it is desirable to make the upper table surface square, with each side being of equal length; however, a table having other regular, or even irregular, upper surface will suffice; and additionally a circular shape in the upper table surface may be utilized. The advantages of such a square shape for the upper playing surface as the preferred embodiment will become evident from the following description.

Table 10 has four conventional support legs located at each corresponding corner 12A, 12B, 12C, 12D, as seen in FIG. 1. These vertically depending support legs are represented by 14A, 14B, 14C, and 14D, but with leg 14C not being seen in the particular perspective shown in FIG. 1. Other support leg variations can be utilized for table 10, however.

At each corner of table 10, indicated above as corners, 12A, 12B, 12C, and 12D, there is located a vertically upwardly projecting net post, these posts being represented individually as 16A, 16B, 16C, 16D, as shown in the drawing. Posts 16A, 16B, 16C, and 16D serve as the anchors for the respective net extensions leading to each corner, as described herein below.

Located in the center of the table 10 is a hollow circular member 18, for receiving insufficiently hit balls. Specifically, circular member 18, as depicted is a cylindrical member having a hollow central disposition and having a circumferential wall, the height of which is substantially the same as the height of the respective corner posts 16A, 16B, 16C, and 16D. The circular member 18 being hollow forms thereby an empty circular area in the middle of the upper surface of Table 10, as readily seen in FIG. 1.

A series of four radiating nets 24A, 24B, 24C, and 24D are connected from respective posts 16A, 16B, 16C, and 16D and extend to corresponding connections on circular member 18 for connection thereto, as seen in FIG. 1. The nets 24A, 24B, 24C, and 24D thus radiate to the respective corners of the table from corresponding positions on circular member 18 creating thereby four equally spaced quadrants on the upper playing surface of Table 10, as indicated by playing areas A, B, C, and D in FIG. 1. Nets 24A, 24B, 24C, and 24D are conventionally constructed and constituted table tennis nets, although nets of other constituency and construction can be utilized.

The table 10 thusly constructed, comprises four quadrants, each substantially pie-shaped in configuration. The four quadrants formed by the intersecting nets 24A, 24B, 24C, and 24D are designated as stations A, B, C, and D for purposes of convenient designation and as labeled on the playing surface in FIG. 1. It must be noted, however, that these station indications are arbitrary and any differentiating designation can be used. The circular cuplike member 18 is situated in the middle of the table for the purpose of receiving a tennis table ball that is not hit into one of the quadrants during game play.

The game is played thusly. A player is located by the table 10, adjacent each of the four stations A, B, C, and D, and the ball is put in play, for instance by a player at station A, who then hits the ball at random to any one of the three other stations B, C, and D. A ball upon reaching or hitting station C, for instance, is then correspondingly hit by the player at C. The player at C can then hit the ball back to any other station A, B, or D, at random until a player at a respective station misses a ball or hits it off the table. A player who hits the ball improperly as just described loses a point. If a player loses a predetermined number of points he drops out of the game and the remaining three players play to eliminate a third and eventually a second player. When two or three players are playing the remaining unmanned stations or players stations are off limits and balls hit into these sectors yield lost points, the same as if a ball was hit off the table.

This game structure involves an additional feature of play. If a player hits a ball into the inside of circular member 18, he loses two points, or whatever number of points may be predesignated. Thus, in the subject game, a player loses a point if the ball is hit off the table without first hitting the surface of the other three sectors. The player also loses a point if he fails to return a ball properly hit into his sector. Moreover, a player loses two points if the ball falls into the middle of circular member 18. If a player loses fifteen points or any other amount designated or agreed upon by the players, he drops out of the game and the remaining three play until two remain, as discussed above. Thereupon the remaining two persons play until one of the two loses under the rules discussed above.

There are many other variations that can be used in the play of the foregoing game, including the use of two or three players or even using partners. The scoring system used can be innovated according to the whims of the players. While specific game features have been described, it must be remembered that other embodiments are available and the description of this specific embodiment is not to be considered delimiting on the scope of the subject invention.

I claim:

1. A playing table for a variation of table tennis comprising:

(a) a table member having a planar playing surface of rectangular shape on its upper surface;

(b) a cylindrical member for receiving and retaining insufficiently hit balls, said cylindrical member being of hollow disposition and open at each end, said hollow member being located in the center of the table surface, said cylindrical member being positioned on said table surface with its one end resting on the table surface with the other end thereof being open and facing upwardly;

(c) a plurality of radiating nets extending from the outer periphery of the cylindrical member, each of said radiating nets extending in a different direction to the edge of the upper surface of the table member.

2. A game apparatus for a variation of table tennis comprising:

(a) a playing surface having outer peripheral limits;

(b) a hollow member with an opening located on the upper part thereof, said hollow member extending upwardly from said playing surface and being located in the center of the playing surface and having solid sides around its peripheral circumference for retaining insufficiently hit balls;

(c) four nets extending in radiating fashion from the hollow member to arbitrary points in the outer limits of the playing surface.

* * * * *